US006761089B2

(12) United States Patent
Bergamo

(10) Patent No.: US 6,761,089 B2
(45) Date of Patent: Jul. 13, 2004

(54) TOOL FOR REMOVING SCREWS WITH DAMAGED HEADS

(75) Inventor: Peter J. Bergamo, Wolcott, CT (US)

(73) Assignee: ProQual, LLC, Wolcott, CT (US)

( * ) Notice: Subject to any disclaimer, the term of this patent is extended or adjusted under 35 U.S.C. 154(b) by 0 days.

(21) Appl. No.: 10/369,382

(22) Filed: Feb. 19, 2003

(65) Prior Publication Data

US 2004/0000218 A1 Jan. 1, 2004

Related U.S. Application Data

(60) Provisional application No. 60/392,063, filed on Jul. 1, 2002.

(51) Int. Cl.[7] ..... B25B 13/50

(52) U.S. Cl. ..... 81/53.2; 81/441

(58) Field of Search ..... 81/53.2, 441, 459; 7/158, 165; 408/223–225, 227, 229–230

(56) References Cited

U.S. PATENT DOCUMENTS

| | | | | | |
|---|---|---|---|---|---|
| 252,704 | A | * | 1/1882 | Southwick | 408/224 |
| 1,863,046 | A | * | 6/1932 | Githens et al. | 81/441 |
| 2,694,328 | A | * | 11/1954 | Freniere | 81/53.2 |
| 2,897,695 | A | * | 8/1959 | Winslow | 408/224 |
| 5,031,487 | A | * | 7/1991 | Polonsky | 81/53.2 |
| 5,251,516 | A | * | 10/1993 | Desaulniers | 81/53.2 |

* cited by examiner

*Primary Examiner*—D. S. Meislin
(74) *Attorney, Agent, or Firm*—Peter L. Costas

(57) ABSTRACT

A double-ended hexagonal shank tool bit for extracting Phillips head or similar screws with damaged heads. One end of the tool shapes the screw head recess to a flared opening. The other end of the tool is tapered with left-hand screw threads and diametrically opposite longitudinal gashes arranged to enable the tool to engage the sides of the shaped recess and remove the screw.

8 Claims, 3 Drawing Sheets

TOOL FOR REMOVING SCREWS WITH DAMAGED HEADS

CROSS REFERENCE TO RELATED APPLICATIONS

This application claims priority under my co-pending provisional patent application Serial No. 60/392,063, filed Jul. 1, 2002.

BACKGROUND OF THE INVENTION

This invention relates to a tool for extracting screws with damaged screw heads. More specifically, this invention relates to a single-piece tool adapted to be installed in the chuck of a counter-clockwise rotating drill to extract screws with damaged screw heads of the type with symmetrical recesses, such as Phillips or Robinson type screw heads.

The prior art discloses a number of threaded devices for removing broken bolts or studs. For instance, U.S. Pat. No. 1,105,535, which issued Jul. 28, 1914 to J. O. Roberts, discloses merely a steeply pitched left-hand auger bit adapted to be inserted into a hole separately drilled in the broken bolt. The bit is turned counter-clockwise to remove the broken bolt.

U.S. Pat. No. 2,062,383, which issued Dec. 1, 1936 to M. A. West discloses a double-ended tool having threads of opposite hand on its respective ends. The reaming and removing end has a beveled tip and the driving end has a flat tip. Both ends operate in the recess of a special screw.

U.S. Pat. No. 2,281,164 which issued Apr. 28, 1942 to H. S. Maling discloses a right-hand threaded sleeve adapted to be screwed into the hole of the broken bolt; the sleeve having a left-hand threaded bore into which a threaded mandrel is screwed, the mandrel having teeth or nibs on its bottom to dig into the bolt remnant so that the remnant is removed as the sleeve is unscrewed.

A screw extractor in the Berendzen U.S. Pat. No. 4,078,458 which issued Mar. 14, 1978 discloses a drill on the end of a tapered threaded cone whereby a hole can be drilled in the remnant and, drilling farther, the cone can engage the margins of the hole to spin the remnant out of its threaded hole.

A number of extractor patents have issued to Eli Polonsky in which a left-hand drill bit is provided with a gripping fixture on its stem, and adapted to bite into the hole made by the drill so that the remnant may be removed in a single operation as the device is turned counter-clockwise. The Polonsky patents are U.S. Pat. No. 4,604,917, which issued Aug. 22, 1986; U.S. Pat. No. 4,777,850, which issued Oct. 28, 1928; and U.S. Pat. No. 5,032,487, which issued Jul. 16, 1991.

U.S. Pat. No. 5,251,516 and U.S. Design Pat. D 340,184, both issued Oct. 12, 1993 in the name of Donald Desaulniers and assigned to Alden Corporation, disclose tools for extracting broken bolts and the like. One end of the tool drills a cylindrical hole in the remnant, and the other end has a gently tapered extraction section with a left-hand thread for biting into the side of the hole thus drilled to enable removing the remnant.

Most of the previous extractor techniques involve first drilling a hole into a remnant in which the screw head is broken off or missing, and then inserting some form of extractor which engages the drilled hole thereby allowing the remnant to be rotated out of its bore. However in many cases, the screw head remains attached to the screw proper, but the screw head is damaged when attempting to remove the screw. This problem is particularly acute when a screw head has a symmetrical recess adapted to mate with a special tool, which damages the screw head while attempting to remove the screw, so that it can no longer obtain a purchase on the screw head. In such a case the tool will merely turn in the recess and slip from one position to the next without generating enough torque to remove the screw. Typical of this problem are Phillips head and Robinson head screws, which become damaged and are difficult or impossible to remove with the regular tools designed for this purpose.

Accordingly, one object of the present invention is to provide an improved tool for removing screws or bolts with damaged screw heads.

Another object of the invention is to provide an improved single-piece tool adapted to be installed in the chuck of a counter-clockwise rotating drill to extract screws with damaged screw heads of the type with symmetrical recesses, such as Phillips or Robinson type screw heads.

SUMMARY OF THE INVENTION

Briefly stated, the invention comprises a tool for extracting screws with damaged screw heads of the type with a symmetrical center recess defining circumferentially spaced recess extensions having a major diameter, alternating with resistive sections having a minor diameter. The tool has a central section with flat longitudinal surfaces adapted to be engaged by a drill chuck, a left-hand recess-forming section at one end of the central section, the recess-forming section having a forming distal end with a first portion arranged to make a cylindrical drilled hole with a diameter intermediate the major and minor diameters into the resistive sections and a second flared portion curving away from the axis of rotation so as to form the resistive sections into a flared shape, which is designed to limit the depth of the cylindrical hole so that it does not extend from the screw head into the screw proper. A screw-removing section is provided at the other end of the central section, the screw-removing section having a tapered portion extending toward its distal end and being formed with left hand threads on the exterior of the tapered portion, the tapered portion being at an angle such that the tapered portion threads will engage the flared walls of the resistive sections as the tool is inserted into the recess. Preferably the tapered portion further includes at least one longitudinal gash extending along the tapered portion and interrupting the threads, so as to facilitate engagement of the threads to enhance the screw-removing process. In its preferred form, the tapered portion is frusto-conical with two diametrically opposed gashes skewed slightly with the axis of rotation.

BRIEF DESCRIPTION OF THE DRAWINGS

Other features and objects of the invention will be apparent to those skilled in the art after a study of the following specification, including reference to the appended drawings, all of which show a non-limiting embodiment of the invention. In the drawings.

DESCRIPTION OF THE PREFERRED EMBODIMENT

Figure 1:
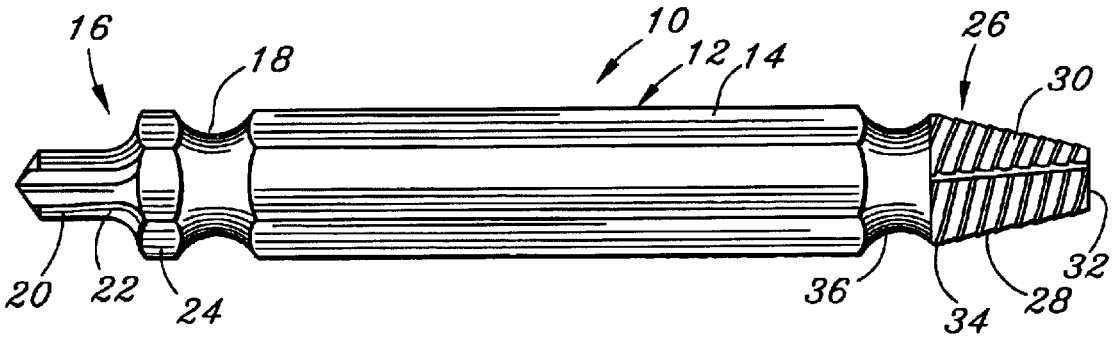
FIG. 1 is a front elevational view of the improved screw-extracting tool.

A tool embodying the invention is shown in FIG. 1 and generally designated 10. It comprises a central section 12 having a plurality of flat longitudinal surfaces 14 adapted to be engaged by a drill chuck. The section 12 of the FIG. 1 embodiment is hexagonal in cross section.

On the left hand end of the central section 12 shown in FIG. 1 there is provided a left-hand recess-forming section 16. The tool is necked in at 18 between the central section 12 and the recess-forming section 16 in order to help locate the tool in certain types of standard chucks. The recess forming section 16 is made up of a cylindrical hole-drilling portion 20 and a flared portion 22 terminating in a short hexagonal portion 24.

On the right hand end of the central section 12 in FIG. 1 is a screw-removing section 26 with a tapered portion 28, narrowing toward its distal end; that is, the end not connected to the central section 12. The tapered resistive section is formed with left-hand threads 30 on the exterior of the taper as shown.

The distal end of the threaded tapered portion is formed with a peripheral chamfer 32. The proximal or larger end of the tapered portion terminates at 34. The area between the central section 12 and the end 34 of the tapered portion is necked down at 36 to help locate the tool in the chuck.

Figure 2A:
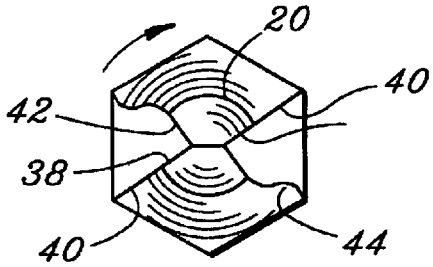
FIGS. 2*a* and 2*b* are enlarged left end and front elevational views, respectively of the recess-forming section, on the left hand end of the tool of FIG. 1, FIGS. 3*a* and 3*b* are enlarged front and right end views, respectively, of the screw-removing section on the right hand end of the tool of FIG. 1, FIGS. 4*a* and 4*b* are enlarged fragmentary elevation section and top plan views, respectively, of a Phillips head screw with a damaged screw head.
Figure 2B:
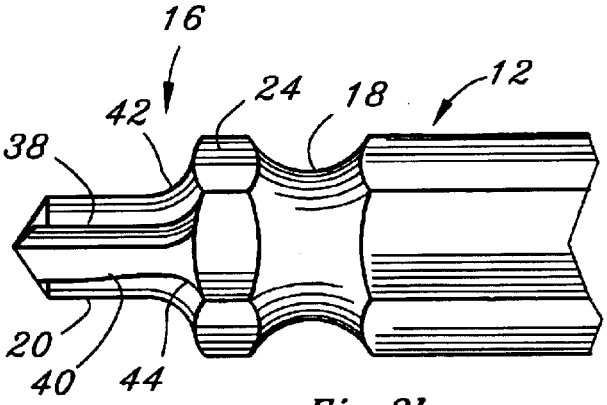

Referring now to FIGS. 2*a* and 2*b* of the drawings further details are shown for the recess-forming section 16. The end elevation view of FIG. 2*a* is shown looking toward the chuck (not shown) of a rotary drill rotating in a left-hand or screw removing direction. A first drilling portion 20 is formed as a drill bit with a pair of oppositely directed cutting edges 38 and a pair of oppositely directed relief edges 40 arranged to drill a cylindrical hole when the drill is rotated in a left-hand direction. Continuing from the drilling portion 20 is a flaring portion 22 with oppositely directed curved cutting edges 42 and curved relief edges 44. The cutting edges 42, 44 flare out until they intersect the hexagonal section and thereby serve to limit the depth to which the recess-forming section can drill the cylindrical hole, the depth of which is preferably only slightly greater than the depth of the screw head so as not to unduly weaken the juncture between the screw head and the screw proper. In order to accomplish this, the axial lengths of the recess-forming section 16 is pre-selected to only slightly exceed the depth of a pre-selected screw head, e.g., on the order of 1/16 inch.

Figure 3A:
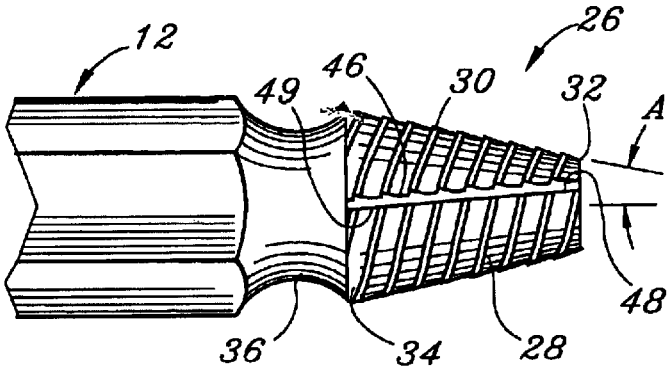
Figure 3B:
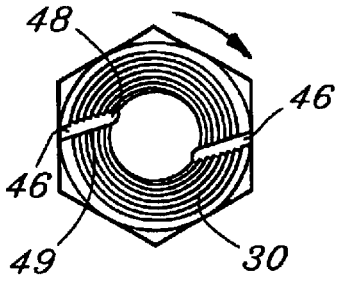

Referring now to FIGS. 3*a* and 3*b* of the drawings, further details are shown for the screw-removing section 26. The end elevation view of FIG. 3*b* is again shown looking toward the chuck (not shown) of a rotary drill rotating in a left-hand or screw removing direction, or clockwise in FIG. 3*b* as indicated by the arrows. The tapered portion 28, shown in FIG. 3*a* is preferably frusto-conical as shown. The taper is at an angle A to the axis of rotation of the tool in a range of from 7° to 17° and is preferably about 12°. The threads 30 are left-hand threads, i.e., helically oriented on the tapered portion so as to screw into the workpiece when the drill is operated in a reverse or left hand direction. The preferred pitch of the threads is in a range of 20 to 28 threads per inch depending on the size screw. For example, I prefer to use 24 threads per inch for standard No. 2 or No. 3 Phillips head screws.

In accordance with one aspect of the invention, two longitudinal gashes 46 are disposed diametrically opposite one another and interrupt the threads 30. There should be at least one such gash and as many as four are useful to enhance the ability of the threads to obtain purchase on the flared walls of the resistive sections of the screw head, as will be explained in further detail.

The gashes 46 are skewed slightly at an angle of about 4° with respect to the axis of rotation. The direction of the skew is such that, as the tool rotates, the distal end 48 of the gash 46 engages the screw first and the proximal end 49 of the gash engages it last. This is evident from the view shown in FIG. 3*b* of the drawing.

Figure 4A:
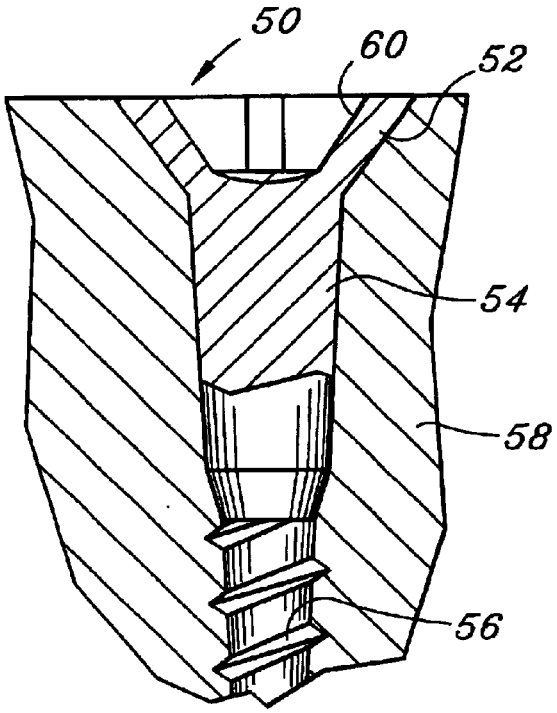
Figure 5A:
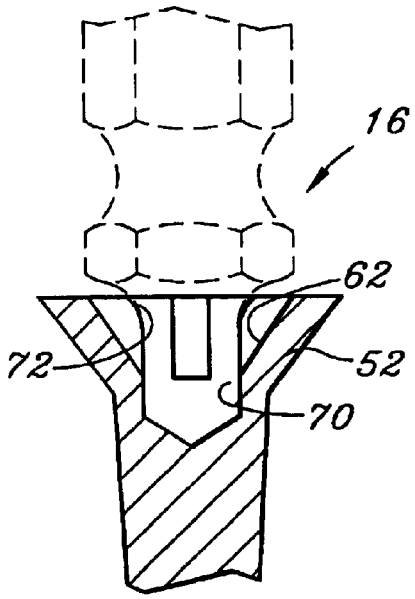
FIGS. 5*a* and 5*b* are enlarged fragmentary elevation section and top plan views, respectively, of the Phillips head screw of FIGS. 4*a* and 4*c* after use of the recess-forming section of the tool.
Figure 5B:
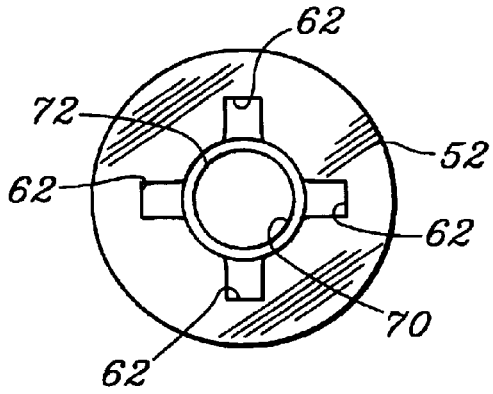

FIGS. 5*a* and 5*b* show a standard Phillips head screw segment 50 with a screw head 52, a gently tapered neck 54 and part of a threaded portion 56 imbedded in a substrate 58. The screw head 52 defines a cruciform recess made up of circumferentially spaced slots 60 with outermost end extensions 62 located at a major diameter at the top of the recess and alternating with circumferentially spaced resistive sections 64 extending radially inward at the top of the recess to a minor diameter. The recess extensions 62 taper down into the screw head from the major diameter at the top of the screw head to the minor diameter at the bottom of the recess as shown in FIG. 4*a*. Normally the resistive sections 64 conform to the minor diameter at the top of the screw head, so that the Phillips head screwdriver can obtain purchase on the screw. However, in this case, the screw head has been damaged by the screwdriver and worn off as shown at 66, so that the screwdriver will no longer function properly.

Figure 4B:
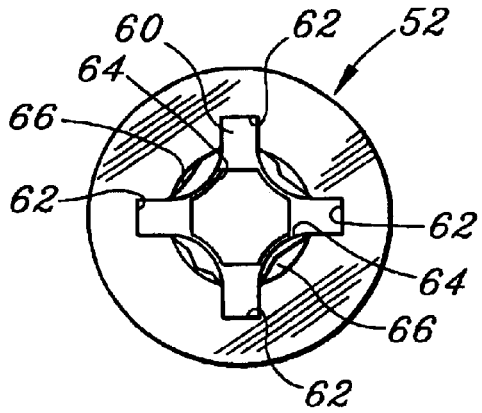

FIGS. 5*a* and 5*b* illustrate the same screw head 52 after the recess-forming section 16 of the tool (shown in dashed lines) has been inserted into the damaged screw head recess and rotated counter-clockwise. A cylindrical hole 70 has been drilled, which is of greater diameter than the minor diameter, and a flared portion 72 has been formed in the resistive sections 64 (FIG. 4*b*). Portions of the slotted extensions 62 are still present.

Figure 6:
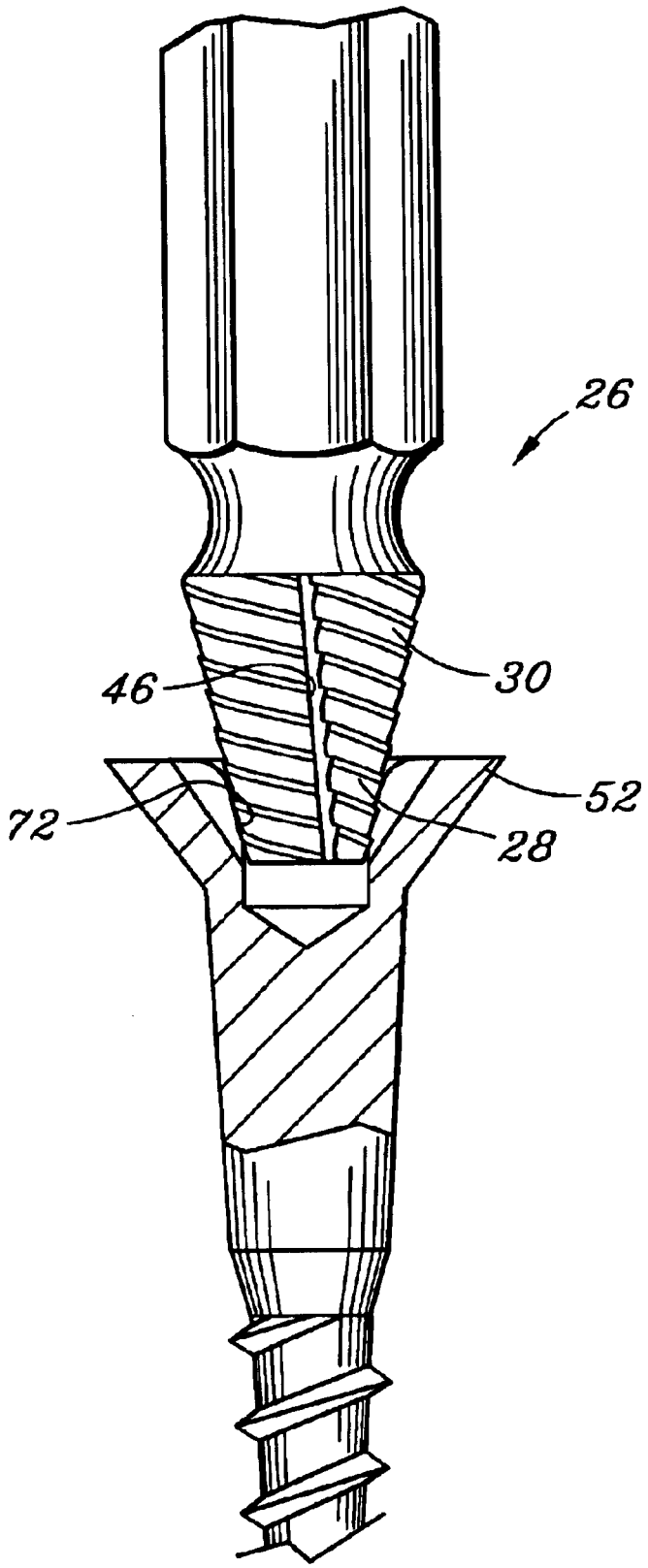
FIG. 6 is an enlarged fragmentary section showing engagement of the previous Phillips head screw by the screw removing section of the tool.

The flared section 72 that is created by the recess-forming section 16 of the tool is precisely formed to cooperate with the screw-removing section 26 of the tool. The tool is removed from the chuck, turned end for end and rotated in a counter-clockwise direction at slow speed. FIG. 6 illustrates the section 26 of the tool, with the tapered portion 28 of the inserted into the screw head recess. The left-hand threads 30 gradually engage the flared walls 72 and bite into the walls lodging the tool firmly into the screw head 52. The engagement action is facilitated by the skewed gashes 46 that provide surfaces on the interrupted threads 30 to enhance the engagement. Since the distal end of the gash engages before the proximal end as the tool rotates, the engagement surfaces of the threads 30 engage the resistive sections 64 of the screw head successively rather than simultaneously. This enhances the ability of the tapered portion 28 to lodge in the resistive section 64. Continued slow rotation exerts counterclockwise torque to withdraw the screw. It should be understood that the tool of the invention is designed to work with a portable or a stationary drill, the condition being that the drill must be run in a counter-clockwise or left-hand direction.

One of the reasons for the center section being hexagonal is that when the screw is removed and still attached to the screw-removing section, the screw may be clamped in a vice and a wrench or socket applied onto the axial central section. Turning the wrench section clockwise, the tool is removed from the damaged screw and ready for reuse. Also, in the removal process, if the drill stalls, the chuck can be opened and the drill disengaged and taken out of the way and a wrench may be used on the hexagonal shape of the central section to manually proceed with the extraction.

The above description relates only to the preferred form of the invention. The invention is not limited to the embodiment described but is receptive to reasonable variations, The protection to which the invention is entitled, therefore, is limited only by the scope of the following claim language and such extension of the right to exclude others from making, using and selling as is appropriate under the doctrine of equivalents.

What is claimed is:

1. A tool for extracting screws with damaged screw heads of the type with a symmetrical center recess defining circumferentially spaced recess extensions having a major diameter at the top of the screw head alternating with circumferentially spaced resistive sections having a minor diameter, said screw heads being susceptible to damage of the resistive sections, said tool having an axis of rotation and comprising:

a central section having a plurality of flat longitudinal surfaces adapted to be engaged by a drill chuck, a left-hand recess-forming section at one end of the central section, the recess-forming section having a forming distal end with a first drilling portion arranged to make a cylindrical drilled hole with a diameter intermediate the major and minor diameters into said resistive sections and a second flaring portion curving away from the axis of rotation so as to form the resistive sections into a flared shape, and a solid screw-removing section at the other end of the central section, the screw-removing section having a tapered frustoconical portion diminishing in cross section extending from its proximal end towards its distal end and being formed with left hand threads on the exterior of the tapered portion, the angle of the taper from the axis of rotation is in the range from 7° to 17°, said tapered portion having at least one narrow and shallow rectilinear gash providing engagement surfaces at the ends of the threads, said at last one gash being skewed with respect to the axis of rotation from the proximal end to the distal end, the direction of skew being such that, as the tool rotates in a counterclockwise direction, said distal end of the gash engages the flared walls of the resistive sections before said proximal end of the gash, said threads being adapted to engage the flared walls of the resistive sections of the screw as the tool is inserted into and rotated counterclockwise about the axis of rotation within the recess to fill said gash quickly with metal removed by said threads and thereby firmly to engage the screw.

2. The tool according to claim 1, wherein the angle of the taper from the axis of rotation is on the order of 12°.

3. The tool according to claim 1, wherein there are two diametrically opposed gashes on said tapered portion.

4. The tool according to claim 1, wherein the pitch of the threads on said tapered portion is in a range between 20 and 28 threads per inch.

5. The tool according to claim 1, wherein the first drilling portion and the second flaring portion are defined by a pair of diametrically opposed cutting edges and a circumferentially spaced pair of diametrically opposed relief edges.

6. The tool according to claim 1 wherein there are two diametrically opposed gashes on said tapered portion.

7. The tool according to claim 6 wherein the width of said gashes is less than the spacing between said threads.

8. The tool according to claim 6 wherein the depth of said gashes is not greater than the depth of said threads.

* * * * *